US012642375B1

(12) United States Patent
Confer et al.

(10) Patent No.: US 12,642,375 B1
(45) Date of Patent: Jun. 2, 2026

(54) EXPANDABLE PILLOW

(71) Applicant: AMERICAN TEXTILE COMPANY, INC., Duquesne, PA (US)

(72) Inventors: Timothy Confer, Duquesne, PA (US); Thanhhoa Nguyen, Duquesne, PA (US); Patrick Seiffert, Duquesne, PA (US); H Jay Spiegel, Mount Vernon, VA (US)

(73) Assignee: AMERICAN TEXTILE COMPANY, INC., Duquesne, PA (US)

( * ) Notice: Subject to any disclaimer, the term of this patent is extended or adjusted under 35 U.S.C. 154(b) by 0 days.

(21) Appl. No.: 19/306,255

(22) Filed: Aug. 21, 2025

(51) Int. Cl.
*A47C 9/10* (2006.01)
*A47G 9/02* (2006.01)
*A47G 9/10* (2006.01)

(52) U.S. Cl.
CPC ..... *A47G 9/0253* (2013.01); *A47G 9/10* (2013.01)

(58) Field of Classification Search
CPC ..... A47G 9/00; A47G 9/0253; A47G 9/10
See application file for complete search history.

(56) References Cited

U.S. PATENT DOCUMENTS 1,876,591 A 9/1932 Bawden
6,009,577 A * 1/2000 Day ..... A47G 9/10 5/636
6,532,611 B1 * 3/2003 Day ..... A47G 9/10 5/636
8,572,779 B2 11/2013 Pratt et al.
8,893,331 B2 * 11/2014 Cupo ..... A47G 9/10 5/636
9,167,922 B1 10/2015 Holbrook et al.
9,167,923 B1 10/2015 Holbrook
9,895,011 B2 * 2/2018 Alletto, Jr. ..... A47G 9/1036
11,141,009 B1 10/2021 Rane
2013/0263377 A1 10/2013 Wootten, Jr.
2017/0347815 A1 * 12/2017 Moeller ..... A47G 9/10
2018/0325291 A1 * 11/2018 Holbrook ..... A47G 9/04
2022/0079358 A1 3/2022 Holbrook et al.

* cited by examiner

*Primary Examiner* — Fredrick C Conley
(74) *Attorney, Agent, or Firm* — H. Jay Spiegel

(57) ABSTRACT

A pillow includes first and second panels that are assembled together by a peripheral seam going all the way around the pillow. A zipper is provided that extends substantially the length of the pillow in the preferred embodiment although, if desired, the zipper can extend substantially the entire width of the pillow. The zipper is spaced from the peripheral seam and is located on one of the two panels of the pillow. A gusset is provided within the chamber defined by the pillow. One edge of the gusset is attached at the peripheral seam and the opposite edge is affixed at one side of the zipper, namely, the side of the zipper remote from the peripheral seam. With the gusset attached as described when the zipper is opened, the fill within the pillow may expand to a greater volume than was the case with the zipper closed.

17 Claims, 10 Drawing Sheets

EXPANDABLE PILLOW

BACKGROUND OF THE INVENTION

The present invention relates to an improved expandable pillow. In the prior art, pillows that are expandable are generally known. However, Applicants are unaware of any such pillow which incorporates all of the features and aspects of the present invention.

The following prior art is known to Applicants: U.S. Pat. No. 1,876,591 to Bawden discloses a pillow that has zippers on its short ends and gussets that are attached to opposite sides of the zipper. This construction allows expansion but the expansion is limited due to the manner of attachment of the gusset to opposite sides of a zipper which is located at a seam.

U.S. Pat. No. 8,572,779 to Pratt et al. discloses a pillow having upper and lower panels and a gusset connected therebetween. The present invention differs from the teachings of Pratt et al. by providing a gusset between one side of a zipper and a seam that allows significant expansion of the pillow when the zipper is open.

U.S. Pat. No. 9,167,922 to Holbrook et al. discloses a pillow having mesh inserts on its ends. These mesh inserts are always exposed and are provided to allow air circulation.

U.S. Pat. No. 9,167,923 to Holbrook discloses a pillow similar to the pillow disclosed in the '922 patent with gussets on its ends to facilitate cross flow of air.

U.S. Pat. No. 11,141,009 to Rane discloses a pillow the size of which is adjustable by adding small pillows within the encasement.

Published Application No. US 2013/0263377 A1 to Wootten, Jr. discloses a customizable pillow the size of which is adjustable by inserting differing sized small pillows within the encasement.

Published Application No. US 2018/0325291 A1 to Holbrook et al. discloses an expandable bed pillow in which in one embodiment a gusset is attached to opposite sides of the zipper which is located between upper and lower panels. This configuration precludes significant expansion of the pillow with the zipper open.

Published Application No. US 2022/0079358 A1 to Holbrook et al. discloses an expandable bed pillow in which in one embodiment a gusset is attached to opposite sides of the zipper which is located between upper and lower panels. This configuration precludes significant expansion of the pillow with the zipper open.

SUMMARY OF THE INVENTION

The present invention relates to an improved expandable pillow. The present invention includes the following interrelated objects, aspects and features:

(1) In a first aspect of the present invention the pillow includes first and second panels that are assembled together by a peripheral seam going all the way around the pillow.

(2) To gain access to the interior of the pillow, a zipper is provided that extends substantially the length of the pillow in the preferred embodiment although, if desired, the zipper can extend substantially the entire width of the pillow. Importantly, the zipper is spaced from the peripheral seam and is located on one of the two panels of the pillow. It is noted that the panels may be considered to be top or bottom or visa-versa since the pillow may easily be oriented with either panel facing upward. In the preferred embodiment, the zipper may be made of nylon. Of course, it may be made of any desired zipper material including metal as desired. The pull for the zipper may be made of nylon, plastic, fabric, or any other desired material.

(3) A gusset is provided within the chamber defined by the pillow. Importantly, one edge of the gusset is attached at the peripheral seam and the opposite edge is affixed at one side of the zipper, namely, the side of the zipper remote from the peripheral seam.

(4) With the gusset attached as described in paragraph (3) above, when the zipper is opened, the fill within the pillow may expand to a greater volume than was the case with the zipper closed. As compared to the prior art in which the gusset is attached between opposite sides of the zipper, by spacing the zipper from the peripheral seam and attaching the gusset between the peripheral seam and the far side of the zipper, significantly greater expansion of the interior volume of the pillow may be accomplished.

(5) If desired, the zipper may be spaced as far away from the peripheral seam as desired. In the preferred embodiment of the present invention, the zipper is spaced approximately one inch from the peripheral seam and parallel therewith. If desired, the zipper can be spaced up to three or even four inches or more from the seam, as desired. Additionally, if desired, the zipper can be arcuate in nature with the ends being closest to the peripheral seam and the middle of the zipper being furthest away from the peripheral seam. In this way, when the zipper is open a greater volume increase in the volume of the pillow may be achieved.

(6) Pillow covers, as is well known, may be made from numerous different materials. The choice of materials is dependent upon various factors including desired firmness or softness, temperature and temperature control, and other factors. For example, a pillow cover is commonly made of a cotton material but can also be made of other materials such as polyester. Additional materials used for pillow covers may include nylon, wood cellulose fibers such as lyocell or rayon, various other fibers such as elastane, or blends of any of these fibers.

As such, it is a first object of the present invention to provide an improved expandable pillow.

It is a further object of the present invention to provide such an expandable pillow in which first and second panels are connected together via a peripheral seam.

It is a yet further object of the present invention to provide a zipper allowing access to the interior gusset of the pillow.

It is a still further object of the present invention to provide such a pillow in which the zipper is located on one panel spaced from the peripheral seam.

It is a yet further object of the present invention to provide such an expandable pillow in which the zipper is substantially parallel to the peripheral seam at a location where it is closest to the peripheral seam.

It is a further object of the present invention to provide such an expandable pillow in which the zipper is arcuate in nature with the ends of the zipper being closest to the nearest portion of the peripheral seam.

It is a still further object of the present invention to provide such an expandable pillow which is preferably made with cotton panels, although the panels may be made of other materials such as described hereinabove.

It is a yet further object of the present invention to provide such a pillow in which the fill or stuffing for the pillow is made of any desired materials including such materials as feathers, down, polyester, shredded or cut memory foam, and others as described hereinabove. It is also contemplated that other types of foam fill or stuffing can be employed or the combination of foam and fibers.

It is a yet further object of the present invention to provide such a pillow in which a gusset is provided to allow expansion of the interior volume of the pillow when the zipper is opened, the gusset having any desired width.

It is a yet further object of the present invention to provide such an expandable pillow in which the gusset is connected on one edge to the seam and at an opposite edge to the side of the zipper remote from the peripheral seam.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
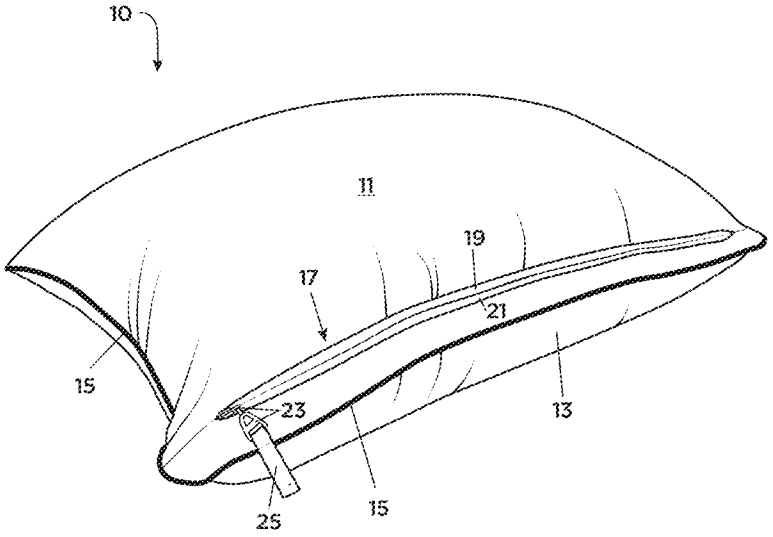
FIG. 1 shows a front perspective view of the inventive expandable pillow with the zipper closed.
Figure 2:
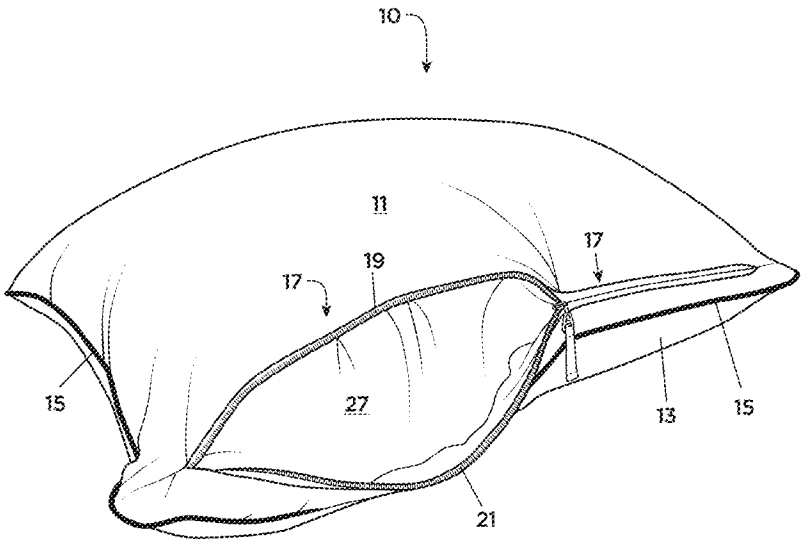
FIG. 2 shows the pillow of FIG. 1 with the zipper partially opened.
Figure 3:
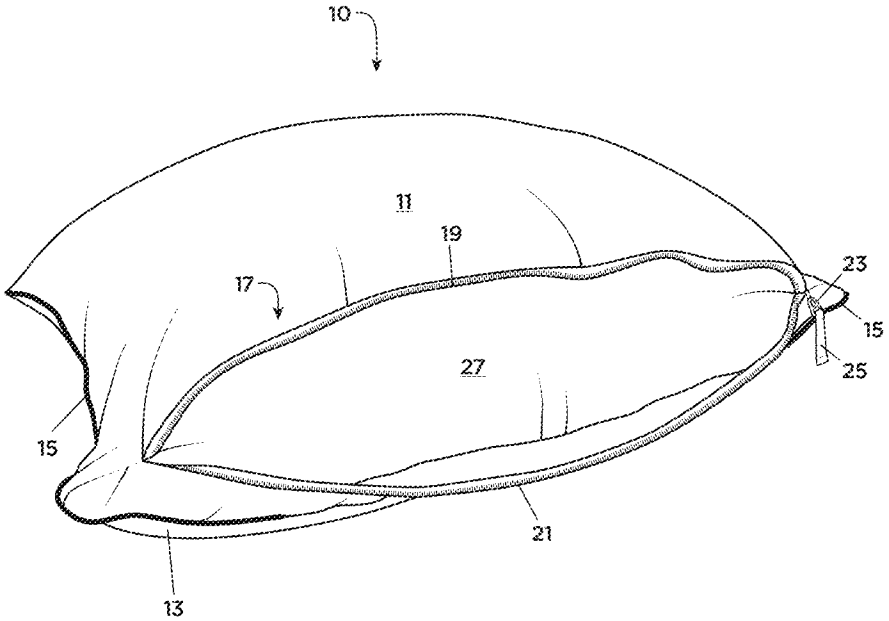
FIG. 3 shows the pillow of FIGS. 1-2 with the zipper completely opened.

With reference first to FIGS. 1-3, the inventive pillow is generally designated by the reference numeral 10 and is seen to include a first panel 11, a second panel 13, and a peripheral seam 15 that extends about the circumference of the pillow and interconnects the first panel 11 with the second panel 13.

Figure 4:
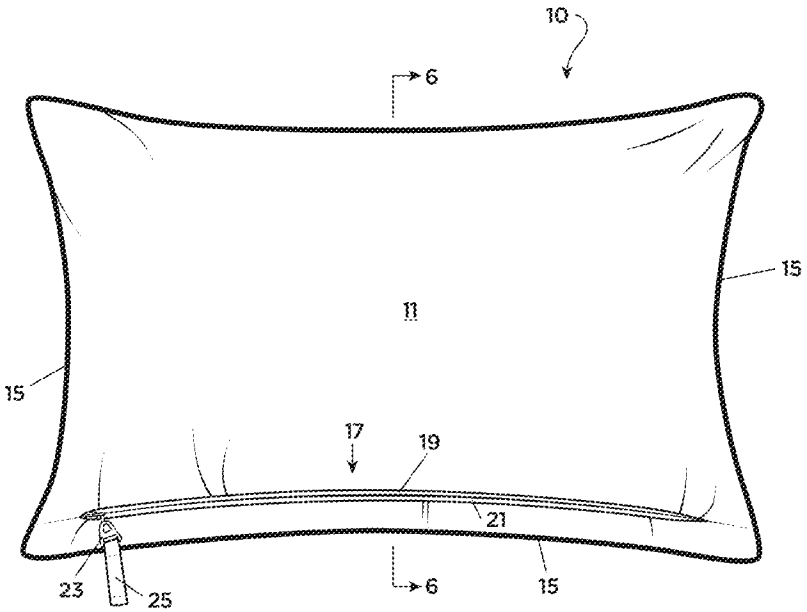
FIG. 4 shows a view of one panel of the inventive pillow with the zipper closed.

As shown in FIGS. 1-3, a zipper 17 is provided on the first panel 11 and as clearly shown in FIGS. 1 and 4, the zipper 17 is spaced from the seam 15 that interconnects the second panel 13 with the first panel 11. The zipper 17 includes a first side 19 which is remote from the seam 15 and a second side 21 which is closer to the seam 15. A zipper pull 23 is utilized in a manner well known to those skilled in the art to open and close the zipper 17. It may include an appendage 25 that may easily be gripped by the user to open and close the zipper 17.

Figure 6:
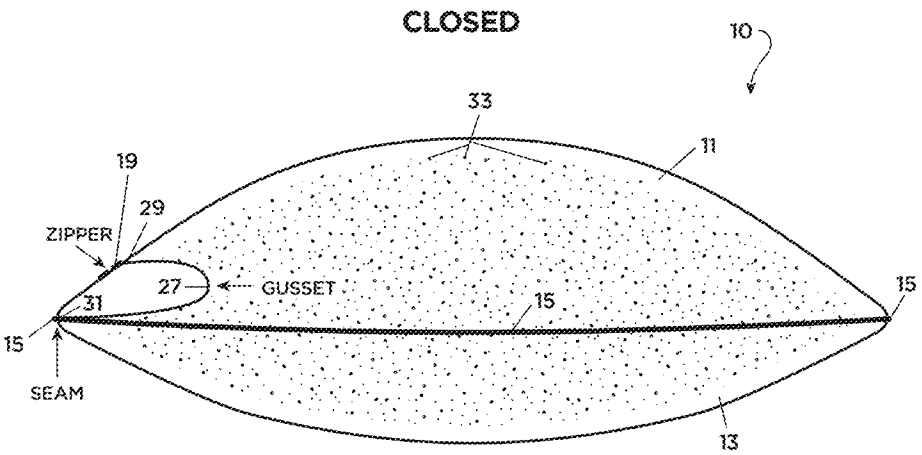
FIG. 6 shows a cross-sectional view along the line 6-6 of FIG. 4.
Figure 7:
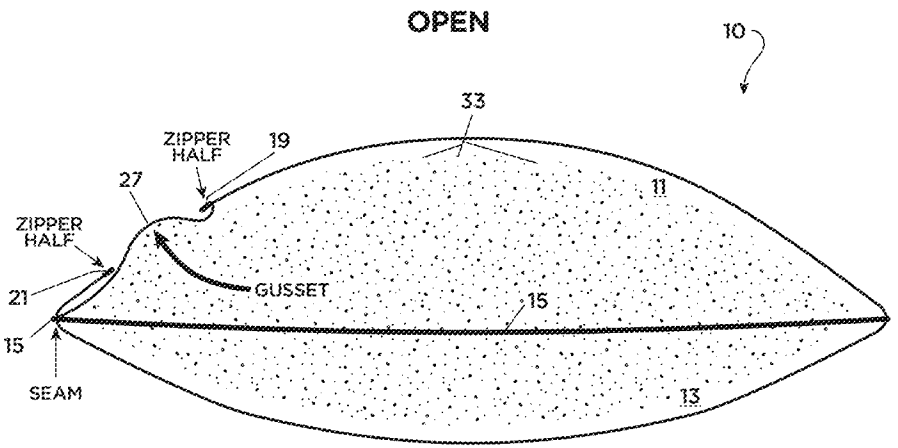
FIG. 7 shows a cross-sectional view along the line 7-7 of FIG. 5.

FIG. 2 shows the zipper 17 partially open. As shown in FIG. 2, with the zipper 17 partially open a gusset 27 is revealed which is within the internal cavity of the pillow 10. With reference to FIGS. 6 and 7, the gusset 27 has a first edge 29 that is connected at the side 19 of the zipper 17 and another opposed side 31 that is connected at the seam 15.

Figure 5:
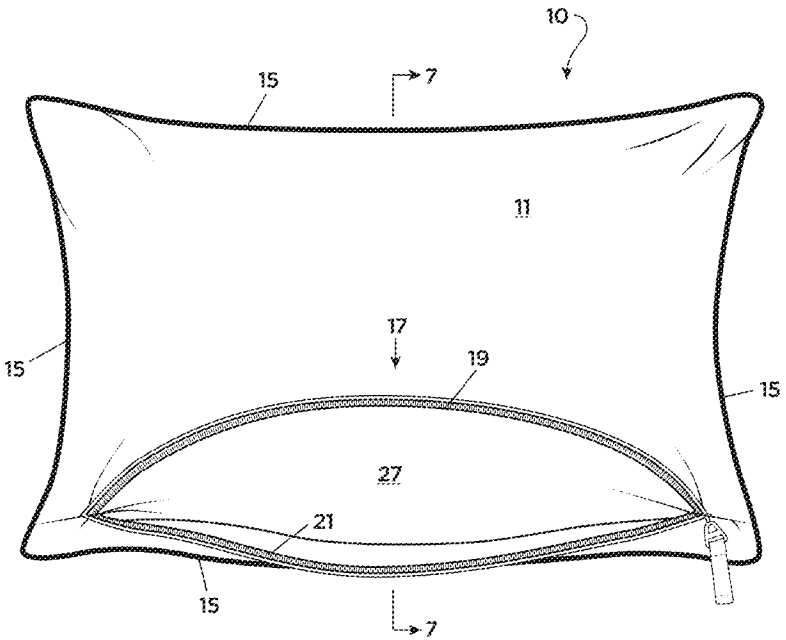
FIG. 5 shows a view of the inventive pillow similar to that of FIG. 4 with the zipper completely opened.

With reference to FIGS. 3 and 5, with the zipper 17 completely open, the entirety of the gusset 27 is revealed. As shown in FIG. 7, when the zipper 17 is completely opened, the gusset 27 may bulge outwardly into the opening created by the open zipper to expand the volume of the pillow 10.

As seen in particular in FIGS. 6 and 7, the interior of the pillow 10 is filled with a stuffing or fill that is designated by the reference numeral 33.

Figure 8:
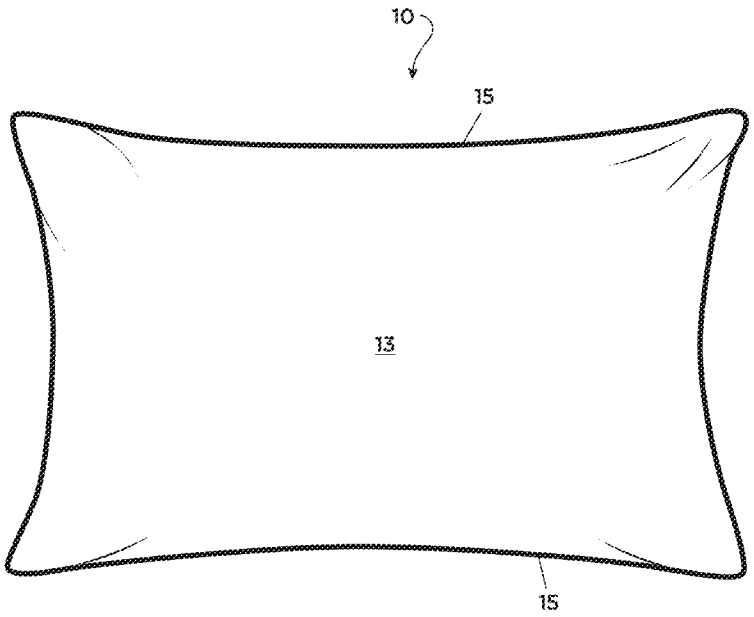
FIG. 8 shows a view of the other panel of the pillow.

FIG. 8 shows the second panel 13 as well as the peripheral seam 15. As is clear from FIG. 8, the second panel 13 of the pillow does not have any zipper structure because the zipper is totally on the first panel. This is also seen in FIG. 9.

Figure 9:
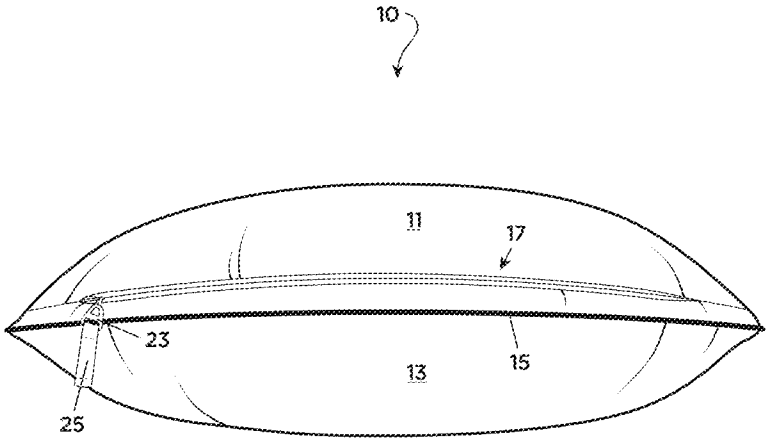
FIG. 9 shows a front view of the pillow with the zipper closed.
Figure 10:
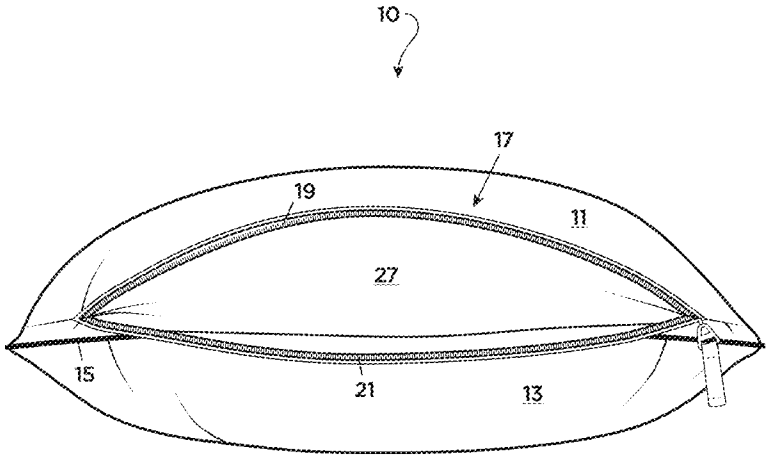
FIG. 10 shows a front view of the pillow with the zipper opened.

FIG. 10 is a view similar to that of FIG. 9 but with the zipper open. FIG. 10 shows the internal gusset which is expanded out as seen in particular in FIG. 7 to increase the volume of the interior of the pillow 10.

As explained earlier, the panels of the pillow or pillow covers may be made of any desired materials. These materials include cotton, polyester, nylon, wood cellulose fibers such as lyocell or rayon, various other fibers such as elastane, or blends of any of these fibers.

Additionally, any desired fill or stuffing may be employed as desired depending upon the preferred specifications of the pillow and its desired performance. These materials for the fill or stuffing may include down, feathers, latex, shredded or cut memory foam, wool, polyester, and others including buckwheat hulls, kapok, and others as desired.

The inventive pillow provides a significant improvement over the prior art. It allows much greater expansion of the volume of the pillow when the zipper is open than is the case in prior art designs. In so doing, it also increases the area of the gusset which enables the gusset to better ventilate the interior of the pillow if the gusset is made air pervious. In this way, the pillow may also perform the function of cooling the head of the user. As such, the gusset may be made of a solid material such as cotton or polyester or may be a mesh material to allow easy ventilation of the interior of the pillow.

While the present invention is disclosed as a rectangular pillow, it may be made in any desired shape including circular, cylindrical, rectangular cubic, and any other desired shape or configuration.

As explained above, while the preferred embodiment shows the zipper as being linear and substantially parallel to the adjacent seam, if desired, the zipper may be arcuate with the ends of the zipper closest to the seam and the middle portion of the zipper being furthest away. In this way, when the zipper is opened, a larger volume of expansion of the pillow may be accomplished since the zipper is opening a larger opening in the bottom panel than would be the case with a linear zipper.

As such, an invention has been disclosed in terms of preferred embodiments thereof which fulfill each and every one of the objects of the invention as set forth hereinabove, and provide a new and useful improved expandable pillow of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. An improved expandable pillow, comprising:

a) a first panel and a second panel;

b) said panels having peripheral edges connected together at a peripheral seam;

c) one of said panels having an opening spaced from said seam and selectively closeable with a zipper movable between opened and closed positions;

d) said pillow defining an internal cavity filled with a fill material;

e) said pillow further including a gusset connected between said zipper and said seam, whereby when said zipper is in said opened position, said gusset permits said internal cavity to expand to a greater volume than its volume with said zipper in said closed position, said zipper having two sides, a first side closest to said seam and a second side furthest from said seam, and wherein a first side of said gusset is connected to said seam and a second side of said gusset is connected to said second side of said zipper.

2. The improved expandable pillow of claim 1, wherein said panels are made of cotton.

3. The improved expandable pillow of claim 1, wherein said gusset is made of a mesh material.

4. The improved expandable pillow of claim 3, wherein said panels are made of cotton.

5. The improved expandable pillow of claim 1, wherein said panels are generally rectangular.

6. The improved expandable pillow of claim 1, wherein said zipper is linear.

7. The improved expandable pillow of claim 6, wherein said zipper has ends located near sides of said one of said panels.

8. The improved expandable pillow of claim 7, wherein said one of said panels comprises a bottom panel.

9. The improved expandable pillow of claim 1, wherein teeth of said zipper are non-metallic.

10. The improved expandable pillow of claim 1, wherein teeth of said zipper are metallic.

11. The improved expandable pillow of claim 1, wherein said zipper is substantially parallel to an adjacent portion of said seam.

12. The improved expandable pillow of claim 11, wherein said zipper is at least one inch spaced from said adjacent portion of said seam.

13. The improved expandable pillow of claim 1, wherein said one of said panels comprises a bottom panel.

14. An improved expandable pillow, comprising:

a) a first panel and a second panel;

b) said panels having peripheral edges connected together at a peripheral seam;

c) one of said panels having an opening spaced from said seam and parallel to an adjacent portion of said seam and selectively closeable with a zipper movable between opened and closed positions;

d) said pillow defining an internal cavity filled with a fill material;

e) said pillow further including a mesh gusset connected between said zipper and said seam, whereby when said zipper is in said opened position, said gusset permits said internal cavity to expand to a greater volume than its volume with said zipper in said closed position, said zipper having two sides, a first side closest to said seam and a second side furthest from said seam, a first side of said gusset being connected to said seam and a second side of said gusset being connected to said zipper, said second side of said gusset being attached at said second side of said zipper.

15. The improved expandable pillow of claim 14, wherein said zipper is linear, and has ends located near sides of said one of said panels.

16. The improved expandable pillow of claim 15, wherein said one of said panels comprises a bottom panel.

17. The improved expandable pillow of claim 14, wherein said zipper is at least one inch spaced from said adjacent portion of said seam.

* * * * *